US009252538B2

(12) United States Patent
Recce et al.

(10) Patent No.: US 9,252,538 B2
(45) Date of Patent: Feb. 2, 2016

(54) RECEPTACLE ASSEMBLY HAVING A LIGHT INDICATOR

(71) Applicant: Tyco Electronics Corporation, Berwyn, PA (US)

(72) Inventors: Patrick Recce, Harrisburg, PA (US); Matthew Ryan Schmitt, Middletown, PA (US); Robert Harrison Wertz, Mechanicsburg, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 21 days.

(21) Appl. No.: 14/193,589

(22) Filed: Feb. 28, 2014

(65) Prior Publication Data

US 2015/0249308 A1 Sep. 3, 2015

(51) Int. Cl.

| | |
|---|---|
| ***H01R 13/648*** | (2006.01) |
| ***H01R 13/641*** | (2006.01) |
| ***H01R 13/717*** | (2006.01) |
| *H01R 12/72* | (2011.01) |
| *H01R 13/6581* | (2011.01) |

(52) U.S. Cl.

CPC ..... *H01R 13/641* (2013.01); *H01R 13/7175* (2013.01); *H01R 12/722* (2013.01); *H01R 13/6581* (2013.01)

(58) Field of Classification Search

CPC ..... H01R 23/688; H01R 23/7073; H01R 13/65802; H01R 13/641; H01R 13/7175

USPC ..... 439/108, 541.5, 607.01, 607.17, 439/607.18, 607.21, 607.25, 939, 489, 490

See application file for complete search history.

(56) References Cited

U.S. PATENT DOCUMENTS

| | | | | |
|---|---|---|---|---|
| 7,249,966 | B2 * | 7/2007 | Long | 439/541.5 |
| 7,575,471 | B2 * | 8/2009 | Long | 439/541.5 |
| 7,641,515 | B1 * | 1/2010 | Szczesny et al. | 439/607.01 |
| 7,651,364 | B2 | 1/2010 | Costello | |
| 7,704,097 | B1 * | 4/2010 | Phillips et al. | 439/607.01 |
| 8,197,282 | B1 * | 6/2012 | Su et al. | 439/541.5 |
| 8,277,252 | B2 * | 10/2012 | Fogg et al. | 439/607.25 |
| 8,419,212 | B2 | 4/2013 | MacDougall et al. | |
| 8,469,744 | B2 * | 6/2013 | Nichols et al. | 439/607.01 |
| 8,545,268 | B2 * | 10/2013 | Fogg et al. | 439/607.25 |
| 8,684,765 | B2 * | 4/2014 | Shirk et al. | 439/490 |
| 8,870,595 | B2 * | 10/2014 | Schmitt et al. | 439/607.25 |

* cited by examiner

*Primary Examiner* — Thanh Tam Le

(57) ABSTRACT

Receptacle assembly including a receptacle housing having a front end, a back end, and an elongated module cavity that extends between the front and back ends. The receptacle assembly also includes a communication connector that is positioned to mate with a pluggable module when the pluggable module is inserted into the module cavity. The receptacle assembly also includes a light source that is positioned proximate to the port opening and supported by the receptacle housing. The light source generates light signals that are viewable at the front end. The receptacle assembly also includes a flexible cable coupled to the light source. The light source generates the light signals based on electrical current received through the flexible cable.

20 Claims, 5 Drawing Sheets

RECEPTACLE ASSEMBLY HAVING A LIGHT INDICATOR

BACKGROUND OF THE INVENTION

The subject matter described herein relates to a receptacle assembly having a light indicator.

At least some known receptacle assemblies, such as input/output (I/O) connector assemblies, are configured to receive a pluggable module and establish a communicative connection between the pluggable module and an electrical connector of the receptacle assembly. As one example, a known receptacle assembly includes a receptacle housing that is mounted to a circuit board and configured to receive a small form-factor (SFP) pluggable transceiver. The receptacle assembly includes an elongated cavity that extends between an opening of the cavity and an electrical connector that is disposed within the cavity and mounted to the circuit board. The pluggable transceiver is inserted through the opening and advanced toward the electrical connector in the cavity. The pluggable transceiver and the electrical connector have respective electrical contacts that engage one another to establish a communicative connection.

In many cases, the communicative connection is confirmed through the use of a light pipe assembly. The light pipe assembly typically includes one or more light pipes in which each light pipe has an input end that is positioned above a light-emitting diode (LED) and an output end positioned near the front of the receptacle assembly. The light pipe extends through or around the receptacle housing between the input and output ends. The LED is mounted to the circuit board near the electrical connector. When the pluggable transceiver is properly mated with the electrical connector, the LED emits light indicating that a communicative connection has been established. The light enters the light pipe through the input end, propagates through the light pipe, and exits the light pipe at the output end. The emitted light notifies a user that the pluggable transceiver has established a communicative connection with the electrical connector. In some cases, an additional light pipe may be used that indicates a speed of the data transmission or provides other information regarding the status of the communicative connection.

One challenge often addressed in the design of a receptacle assembly is the transfer of excess heat, which may negatively affect electrical performance. In some cases, the receptacle assemblies are configured to permit air to flow through the receptacle assembly thereby transferring the heat that emanates from the pluggable transceiver and/or the electrical connector to the exterior of the receptacle assembly. Light pipes, however, may occupy space that is proximate to the pluggable transceiver(s) thereby reducing airflow and/or creating unwanted turbulence that negatively affects heat transfer.

Accordingly, there is a need for a receptacle assembly that indicates a status of a connection between a pluggable module and a connector while also permitting a sufficient amount of airflow to transfer heat away from the receptacle assembly.

BRIEF DESCRIPTION OF THE INVENTION

In an embodiment, a receptacle assembly is provided that includes a receptacle housing having a front end, a back end, and an elongated module cavity that extends between the front and back ends. The module cavity has a port opening at the front end that is configured to receive a pluggable module. The receptacle assembly also includes a communication connector that is disposed within the module cavity and positioned to mate with the pluggable module when the pluggable module is inserted into the module cavity. The receptacle assembly includes a light source that is positioned proximate to the port opening. The light source generates light signals that are viewable at the front end. The receptacle assembly also includes a flexible cable coupled to the light source. The flexible cable may extend through or around the receptacle housing. The light source generates the light signals based on electrical current received through the flexible cable. The light signals indicate a status of a communicative connection between the communication connector and the pluggable module.

In an embodiment, a receptacle assembly is provided that includes a receptacle housing having a front end, a back end, and a mating axis extending therebetween. The receptacle housing includes first and second module cavities that are stacked with respect to one another and extend generally parallel to the mating axis. Each of the first and second module cavities has a respective port opening at the front end that is configured to receive a corresponding pluggable module. The receptacle assembly also includes a communication connector having first and second mating interfaces. The first and second mating interfaces are positioned within the first and second module cavities, respectively, to mate with the corresponding pluggable modules. The receptacle assembly also includes a light source that is positioned proximate to the front end. The light source generates light signals that are viewable at the front end. The receptacle assembly also includes a flexible cable coupled to the light source. The light source generates the light signals based on electrical current received through the flexible cable. The light signals indicate a status of a communicative connection between the communication connector and the pluggable modules.

DETAILED DESCRIPTION OF THE INVENTION

Embodiments set forth herein include communication systems and receptacle assemblies and light-indicator assemblies of the same. The receptacle assembly includes a receptacle housing having a front end and a communication connector, such as an electrical connector, that is disposed at least partially within the receptacle housing. The communication connector is configured to communicatively engage a pluggable module inserted into the receptacle housing. The receptacle assembly also includes a light-indicator assembly. Based on a communicative connection between the pluggable module and the communication connector, the light-indicator assembly emits light that is viewable by a user of the pluggable module at the front end of the receptacle housing.

Unlike conventional receptacle assemblies that utilize light pipes to emit the light, embodiments set forth herein generate the light proximate to the front end of the receptacle housing. More specifically, electrical current may be converted into light proximate to the front end and emitted therefrom. The emitted light may indicate a status of the communicative connection. For example, the emitted light may simply confirm that a communicative connection has been established without any indication as to a quality of the connection. Alternatively, the emitted light may not only confirm that a connection has been made but also a quality of the connection. For example, the emitted light may have a designated color (or colors) and/or flash at a designated frequency. The color(s) and/or frequency of flashing may indicate a speed of data transmission or other quality of the communicative connection.

Figure 1:
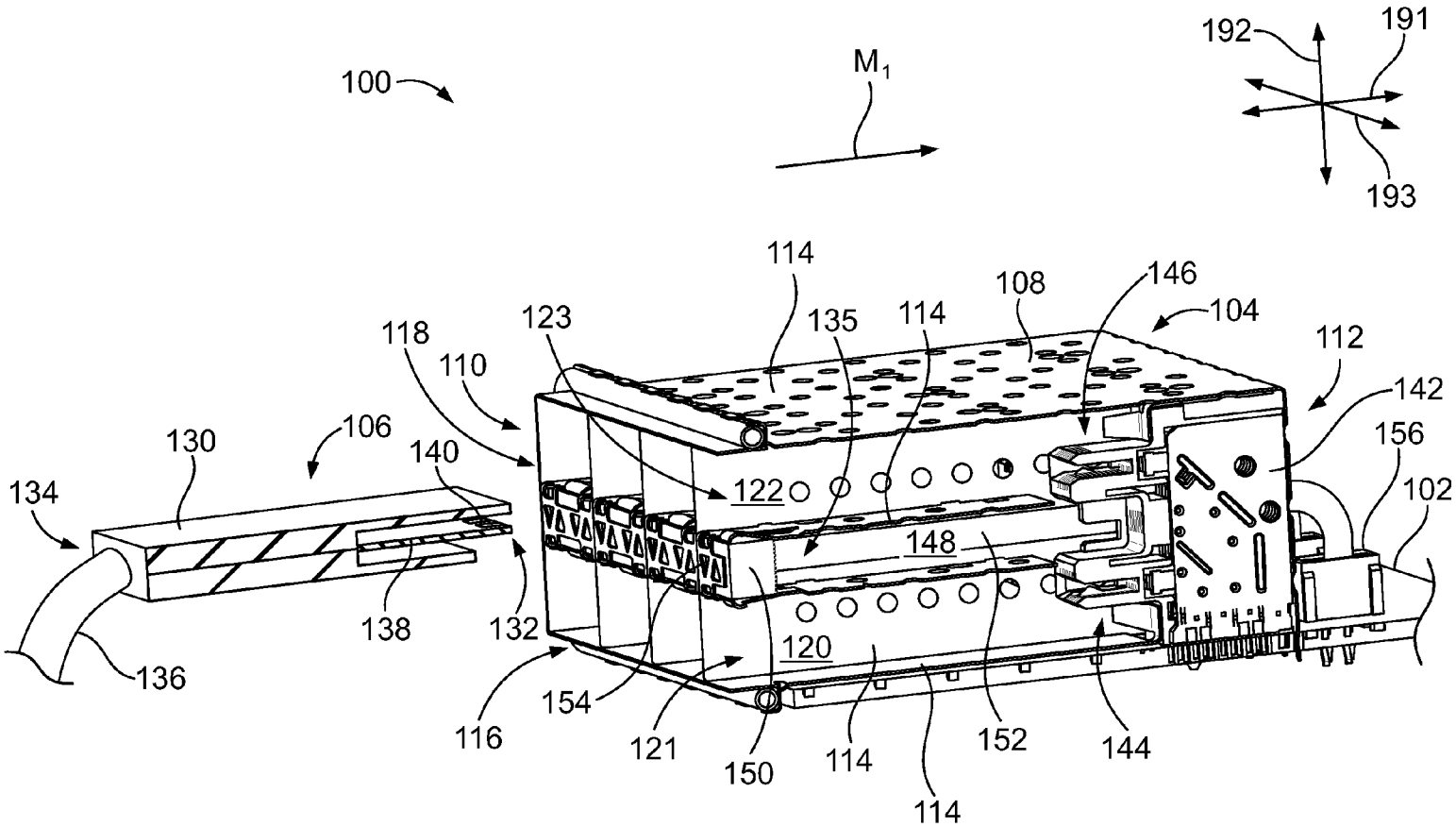
FIG. 1 is a perspective view of a cross-section of a communication system in accordance with an embodiment.

FIG. 1 is a perspective cross-sectional view of a communication system 100 in accordance with an embodiment. The communication system 100 may include a circuit board 102, a receptacle assembly 104 mounted to the circuit board 102, and one or more pluggable modules 106 that are configured to communicatively engage the receptacle assembly 104. The communication system 100 is oriented with respect to a mating or insertion axis 191, an elevation axis 192, and a lateral axis 193. The axes 191-193 are mutually perpendicular with respect to one another. Although the elevation axis 192 appears to extend in a vertical direction parallel to gravity in FIG. 1, it is understood that the axes 191-193 are not required to have any particular orientation with respect to gravity. Moreover, only one pluggable module 106 is shown in FIG. 1, but it is understood that multiple pluggable modules 106 may simultaneously engage the receptacle assembly 104.

The communication system 100 may be part of or used with telecommunication systems or devices. For example, the communication system 100 may be part of or include a switch, router, server, hub, network interface card, or storage system. In the illustrated embodiment, the pluggable module 106 is configured to transmit data signals in the form of electrical signals. In other embodiments, the pluggable module 106 may be configured to transmit data signals in the form of optical signals. The circuit board 102 may be a daughter card or a mother board and include conductive traces (not shown) extending therethrough.

The receptacle assembly 104 includes a receptacle housing 108 that is mounted to the circuit board 102. The receptacle housing 108 may also be referred to as a receptacle cage. The receptacle housing 108 includes a front end 110 and an opposite back end 112. The mating axis 191 may extend between the front and back ends 110, 112. Relative or spatial terms such as "front," "back," "top," or "bottom" are only used to distinguish the referenced elements and do not necessarily require particular positions or orientations in the communication system 100 or in the surrounding environment of the communication system 100. For example, the front end 110 may be located in or facing a back portion of a larger telecommunication system. In many applications, the front end 110 is viewable to a user when the user is inserting the pluggable module 106 into the receptacle assembly 104.

The receptacle housing 108 is configured to contain electromagnetic interference (EMI) and guide the pluggable module(s) 106 during a mating operation. In some embodiments, the receptacle housing 108 is configured to permit air to flow through the receptacle housing 108 to transfer heat (or thermal energy) away from the receptacle assembly 104. To this end, the receptacle housing 108 includes a plurality of housing walls 114 that are interconnected with one another to form the receptacle housing 108. The housing walls 114 may be formed from a conductive material, such as sheet metal and/or a polymer having conductive particles. In the illustrated embodiment, the housing walls 114 are stamped and formed from sheet metal.

In the illustrated embodiment, the receptacle housing 108 includes a first (or bottom) row 116 of elongated module cavities 120 and a second (or top) row 118 of elongated module cavities 122. Each of the module cavities 120, 122 extends between the front and back ends 110, 112. The module cavities 120, 122 have respective port openings 121, 123 that are sized and shaped to receive a corresponding pluggable module 106. The module cavities 120, 122 may have the same or similar dimensions and extend lengthwise in a direction that is parallel to the mating axis 191. In the illustrated embodiment, each module cavity 122 is stacked over a corresponding module cavity 120 such that the module cavity 120 is positioned between the module cavity 122 and the circuit board 102.

In some embodiments, the pluggable module 106 is an input/output cable assembly having a pluggable body 130 and a cable 136. The pluggable body 130 includes a mating end 132 and an opposite loading end 134. The cable 136 is coupled to the pluggable body 130 at the loading end 134. The pluggable body 130 also includes an internal circuit board 138 that is electrically coupled to wires (not shown) of the cable 136. The circuit board 138 includes contact pads 140 at the mating end 132. In FIG. 1, the mating end 132 is configured to be inserted into the module cavity 122 of the receptacle housing 108 and advanced in a mating direction $M_1$ along the mating axis 191.

The receptacle assembly 104 includes a communication connector 142 having first and second mating interfaces 144, 146. The first mating interface 144 is disposed within the module cavity 120, and the second mating interface 146 is disposed within the module cavity 122. The first and second mating interfaces 144, 146 are aligned with the port openings 121, 123, respectively. Each of the first and second mating interfaces 144, 146 includes respective electrical contacts 145, 147 (shown in FIG. 4) that are configured to directly engage the contact pads 140 of the pluggable module 106. Thus, a single communication connector 142 may mate with two pluggable modules 106.

In alternative embodiments, the receptacle assembly 104 does not include the stacked module cavities 120, 122 and, instead, includes only a single row of module cavities 120 or only a single module cavity 120. In such embodiments, the communication connector 142 may have a row of mating interfaces or a single mating interface.

The pluggable module 106 is an input/output (I/O) module configured to be inserted into and removed from the receptacle assembly 104. In some embodiments, the pluggable module 106 is a small form-factor pluggable (SFP) transceiver or quad small form-factor pluggable (QSFP) transceiver. The pluggable module 106 may satisfy certain technical specifications for SFP or QSFP transceivers, such as Small-Form Factor (SFF)-8431. In some embodiments, the pluggable module 106 is configured to transmit data signals up to 2.5 gigabits per second (Gbps), up to 5.0 Gbps, up to 10.0 Gbps, or more. By way of example, the receptacle assembly 104 and the pluggable module 106 may be similar to the receptacle cages and transceivers, respectively, that are part of the SFP+ product family available from TE Connectivity.

Also shown in FIG. 1, the housing walls 114 of the receptacle housing 108 also form a cable cavity 148 that extends generally parallel to the mating axis 191 between the front end 110 and the back end 112. The cable cavity 148 is located between the module cavities 120, 122 and between the first and second mating interfaces 144, 146. More specifically, the module cavity 120, the cable cavity 148, and the module cavity 122 are stacked along the elevation axis 192.

The receptacle assembly 104 has a light-indicator assembly 135 that includes a light source 150 and a flexible cable 152 that is coupled to the light source 150. In the illustrated embodiment, the flexible cable 152 extends through the cable cavity 148. In other embodiments, the flexible cable 152 may extend through other portions of the receptacle housing 108 or may extend around, over, or under the receptacle housing 108.

The light source 150 is supported or held by the receptacle housing 108 proximate to the front end 110. The light source 150 includes a light-emitting element 154 that generates light signals 330 (shown in FIG. 5) that are viewable to a user at the front end 110. The light signals 330 generated by the light-emitting element 154 may indicate to the user a status of the communication connector 142. More specifically, the status may characterize the communicative connection between the pluggable module 106 and the communication connector 142. For example, the status may be represented by a color of the light signals 330 and/or a frequency of flashing of the light signals 330.

The status is communicated to the light source 150 based on electrical current received through the flexible cable 152. The electrical current may be in the form of data signals and/or electrical power. Based on the data signals and/or electrical power, the light source 150 generates the light signals 330 at the front end 110. Unlike known receptacle assemblies that generate light signals 330 at the circuit board and proximate to a back end of the receptacle assembly, which are then transmitted through light pipes to the front end, the light source 150 produces the light signals 330 proximate to the front end 110 and emits the light signals 330 at the front end 110 for viewing by the user. In the illustrated embodiment, light pipes are not used by the receptacle assembly 104. In other embodiments, the receptacle assembly 104 may utilize light pipes in addition to the light-indicator assembly 135. For example, light pipes may be positioned in front of the light source 150 to transmit the light signals 330 generated by the light source 150 to the front end 110. In such embodiments, the light indicator assembly may still allow a sufficiently sized open space between the module cavities 120, 122 to permit airflow therebetween.

In FIG. 1, the flexible cable 152 is a flex circuit that includes one or more conductors or traces embedded within a flexible substrate, such as polyimide. As shown, the flexible cable 152 is a strip or ribbon that extends flat alongside one of the housing walls 114. The flexible cable 152 may have other shapes, paths, and/or orientations within the cable cavity 148. In other embodiments, the flexible cable 152 may be an insulated wire or a bundle of insulated wires.

In some embodiments, the flexible cable 152 occupies a relatively small amount of space within the cable cavity 148. For example, the flexible cable 152 may occupy less than 15% of a total volume of the cable cavity 148 in which the total volume is measured between the light source 150 and the communication connector 142 and between the housing walls 114 that define the cable cavity 148. In certain embodiments, the flexible cable 152 may occupy less than 10% or, more specifically, less than 7% of the total volume of the cable cavity 148. In more particular embodiments, the flexible cable 152 may occupy less than 3% of the total volume of the cable cavity 148. The flexible cable 152 has a cross-section taken transverse to the mating axis 191. In some embodiments, the cross-section is uniform as the flexible cable 152 extends between the communication connector 142 and the light source 150. In some embodiments, an area of the cross-section of the flexible cable 152 (or cross-sectional area) may be less than 15% of an area of a cross-section of the cable cavity 148. In particular embodiments, the cross-sectional area of the flexible cable 152 may be less than 10% of the cross-sectional area of the cable cavity 148. In more particular embodiments, the cross-sectional area of the flexible cable 152 may be less than 7% or less than 3% of the cross-sectional area of the cable cavity 148.

In some embodiments, the receptacle assembly 104 includes a light-source connector 156 that is mounted to the circuit board 102. The light-source connector 156 is communicatively coupled to the communication connector 142 through the circuit board 102 and electrically coupled to the flexible cable 152. The light-source connector 156 is configured to transmit at least one of data signals or electrical power to the light source 150 based on a performance of the communication connector 142 or, more specifically, based on a status of the communicative connection between the pluggable module 106 and the communication connector 142. As shown in FIG. 1, the flexible cable 152 extends from the light-source connector 156 to the light source 150. In other embodiments, the light-source connector 156 (or the functions thereof) may be incorporated with the communication connector 142. In such embodiments, the flexible cable 152 may be directly coupled to the communication connector 142.

Figure 2:
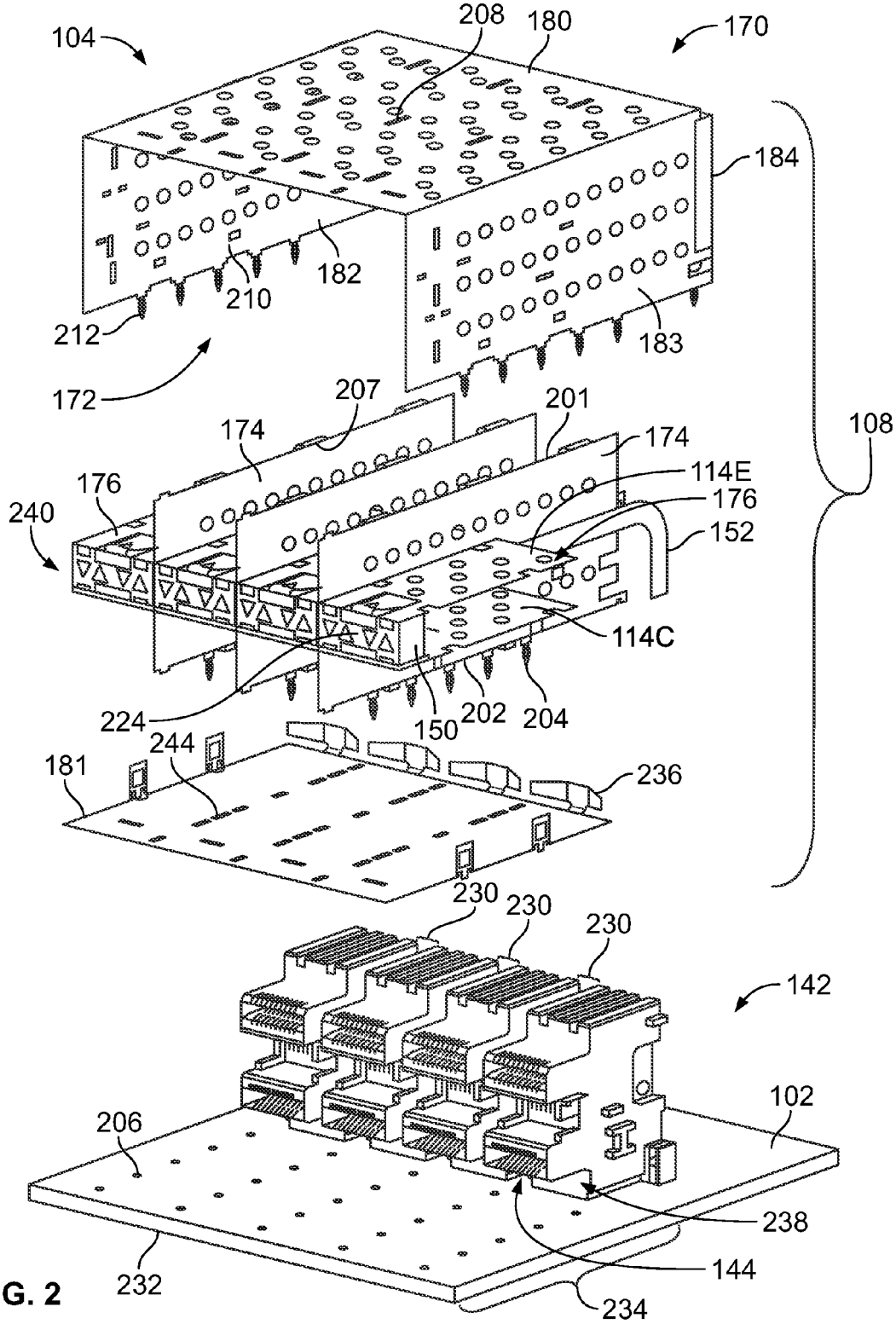
FIG. 2 is a partially exploded view of a receptacle assembly formed in accordance with an embodiment that may be used with the communication system of FIG. 1.

FIG. 2 is a partially exploded view of the receptacle assembly 104 and illustrates the receptacle housing 108 and a plurality of the communication connectors 142 mounted to the circuit board 102. In some embodiments, the receptacle housing 108 is formed from a plurality of interconnected panels or sheets. For example, the receptacle housing 108 includes a main panel or shell 170 that surrounds a housing cavity 172, a plurality of interior panels 174, a base panel 181, and a plurality of port or frame spacers 176. Each of the main panel 170, the interior panels 174, and the port spacers 176 may be stamped and formed from sheet metal. As described in greater detail below, each of the main panel 170, the interior panels 174, and the port spacers 176 may form one or more of the housing walls 114 that define the module cavity 120, the module cavity 122, and the cable cavity 148 as shown in FIG. 1. As shown in FIG. 2, the main panel 170 includes an elevated wall 180, sidewalls 182, 183, and a back wall 184. The elevated wall 180 is located furthest from the circuit board 102 when the receptacle assembly 104 is constructed. The base panel 181 is configured to interface with the circuit board 102. The sidewalls 182, 183 and the back wall 184 are configured to extend from the circuit board 102, when mounted thereto, to the elevated wall 180.

The interior panels 174 and the port spacers 176 are configured to be positioned within the housing cavity 172. Within the main panel 170, the interior panels 174 and the port spacers 176 apportion or divide the housing cavity 172 into the separate module cavities 120, 122 (FIG. 1) and the separate cable cavities 148 (FIG. 1). Each of the port spacers 176 includes a pair of opposing housing walls 114C, 114E and a front wall 224 that extends between the housing walls 114C, 114E. The light source 150 is held between the housing walls 114C, 114E proximate to the front wall 224.

In the illustrated embodiment, each of the interior panels 174 has a panel edge 201 that interfaces with the elevated wall 180 and a panel edge 202 that interfaces with the base panel 181 and/or the circuit board 102. The panel edge 202 may include mounting pins or tails 204 that are configured to mechanically engage and electrically couple to vias or thru-holes 206 of the circuit board 102. The panel edge 201 may include tabs or latches 207 that are configured to be inserted through slots 208 of the elevated wall 180 to couple to the elevated wall 180. Likewise, the sidewalls 182, 183 and the back wall 184 may have panel edges 210 that include mounting pins or tails 212 configured to mechanically engage and electrically couple to corresponding vias 206 of the circuit board 102.

The main panel 170, the base panel 181, the interior panels 174, and the port spacers 176 may comprise conductive material, such as metal or plastic. When the receptacle housing 108 is mounted to the circuit board 102, the receptacle housing 108 and the receptacle assembly 104 are electrically coupled to the circuit board 102 and, in particular, to ground planes (not shown) within the circuit board 102 to electrically ground the receptacle housing 108 and the receptacle assembly 104. As such, the receptacle assembly 104 may reduce EMI leakage that may negatively affect electrical performance of the communication system 100 (FIG. 1).

In some embodiments, the receptacle housing 108 may be assembled by positioning the base panel 181 in front of the communication connectors 142. More specifically, the circuit board 102 has a front edge 232 and a forward section or area 234 that extends between the front edge 232 and the communication connectors 142. The base panel 181 may be positioned to extend along the forward section 234. As shown, the base panel 181 includes a plurality of body shields 236. When the base panel 181 is located on the circuit board 102, each of the body shields 236 may be positioned at a housing gap 238 that extends between the first mating interface 144 of a corresponding communication connector 142 and the circuit board 102.

In some embodiments, the port spacers 176 and the interior panels 174 are interconnected as an interior sub-assembly 240 and then advanced into the housing cavity 172 to couple to the main panel 170. The main panel 170 and the interior sub-assembly 240 may then be mounted to the circuit board 102 such that each of the interior panels 174 advances through a corresponding wall gap 230 that is located between adjacent communication connectors 142. Alternatively, the interior sub-assembly 240 may be mounted to the circuit board 102 and then the main panel 170 may be mounted to the circuit board 102. When the interior sub-assembly 240 and the main panel 170 are mounted to the circuit board 102, the respective mounting pins 204, 212 are inserted into the corresponding vias 206. Prior to being inserted into the vias 206, the mounting pins 204 are inserted through openings 244 of the base panel 181.

At some time during construction of the receptacle assembly 104, the flexible cables 152 may be coupled to the respective light sources 150 and the respective light-source connector 156 (FIG. 1) or, alternatively, the communication connector 142. For example, the light sources 150 may be connected to the corresponding flexible cables 152 and then disposed within the port spacers 176 between the housing walls 114C, 114E. With the lights sources 150 held between the housing walls 114C, 114E, the port spacers 176 may then be coupled to the interior panels 174 to form the interior sub-assembly 240.

Figure 3:
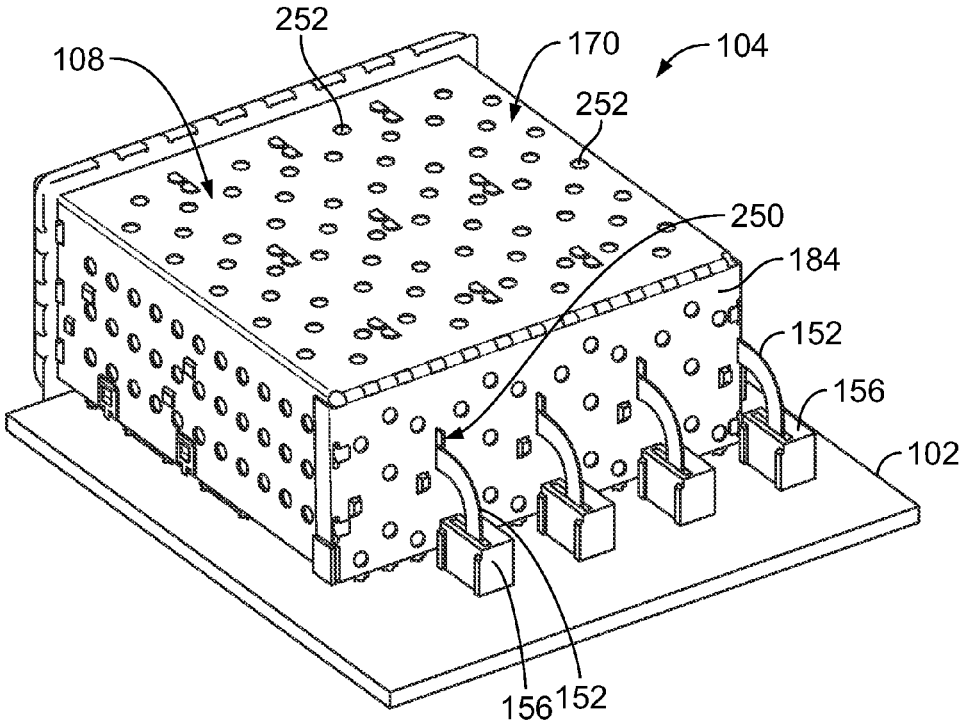
FIG. 3 is a rear perspective view of the receptacle assembly of FIG. 2.

FIG. 3 is a rear perspective view of the fully constructed receptacle assembly 104. As shown, the light-source connectors 156 may be positioned adjacent to the back wall 184. In alternative embodiments, the receptacle housing 108 may be shaped to include the light-source connectors 156 within the housing cavity 172 (FIG. 2). The light-source connectors 156 may include circuitry (not shown) that is communicatively coupled to the communication connectors 142 (FIG. 1). For example, the light-source connectors 156 may be electrically coupled to the communication connectors 142 through the circuit board 102. Each of the light-source connectors 156 may detect an electrical performance of the corresponding communication connector 142 when the communication connector 142 is mated with the corresponding pluggable module 106 (FIG. 1). The light-source connectors 156 may receive input signals from the communication connector 142 that are indicative of the electrical performance, process the input signals to determine the status of the communicative connection, and provide output signals that are representative of the status to the corresponding flexible cable 152. The output signals are then transmitted to the light source 150 (FIG. 1).

In some embodiments, the back wall 184 may include a plurality of windows or openings 250. In the illustrated embodiment, the windows 250 are slots that have similar dimensions as the flexible cables 152. However, other configurations may be used. Each of the windows 250 may provide access to one of the wall gaps 230 (FIG. 2) between adjacent communication connectors 142. Each of the wall gaps 230 may permit access to the housing cavity 172 and/or one of the cable cavities 148 (FIG. 1).

FIG. 3 illustrates the receptacle assembly 104 in an operable state. As shown, the receptacle housing 108 includes a plurality of wall openings 252 through the main panel 170 and the back wall 184. The wall openings 252 may be located with respect to one another and other wall openings 254, 256 (shown in FIG. 4) within the housing cavity 172 to permit a designated airflow through the housing cavity 172. More specifically, the airflow may be configured in a designated manner to transfer heat generated within the receptacle housing 108 away from the receptacle assembly 104. Although not shown in FIG. 3, the receptacle assembly 104 may be located within an environment that has forced air for cooling the receptacle assembly 104. For instance, a cooling fan (not shown) may be positioned near the receptacle assembly 104.

Figure 4:
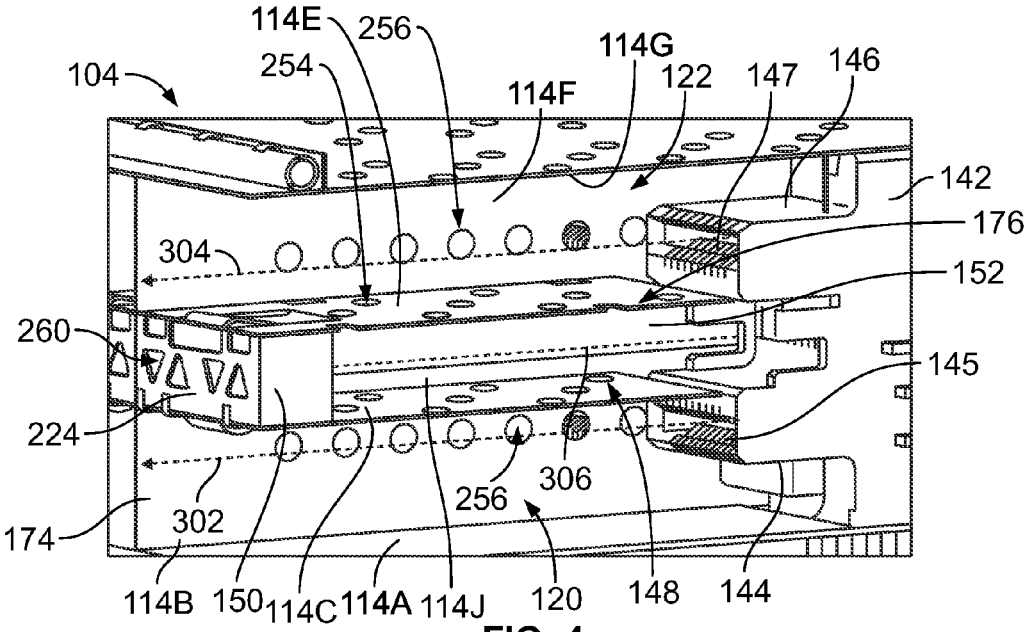
FIG. 4 is an enlarged side cross-sectional view of the receptacle assembly of FIG. 2.

FIG. 4 is an enlarged side perspective view of the receptacle assembly 104 with the sidewall 183 (FIG. 2) removed to illustrate the module cavities 120, 122 and the cable cavity 148 in greater detail. The module cavities 120, 122 extend along respective module axes 302, 304. The modules axes 302, 304 extend parallel to the mating axis 191 (FIG. 1) and extend through respective centers of the first and second mating interfaces 144, 146. As shown, the first and second mating interfaces 144, 146 include electrical contacts 145, 147, respectively. The electrical contacts 145, 147 are configured to engage the contact pads 140 (FIG. 1) of the corresponding pluggable module 106 (FIG. 1). The cable cavity 148 has a cavity axis 306 that extends through a center of the cable cavity 148 and parallel to the module axes 302, 304.

Figure 6:
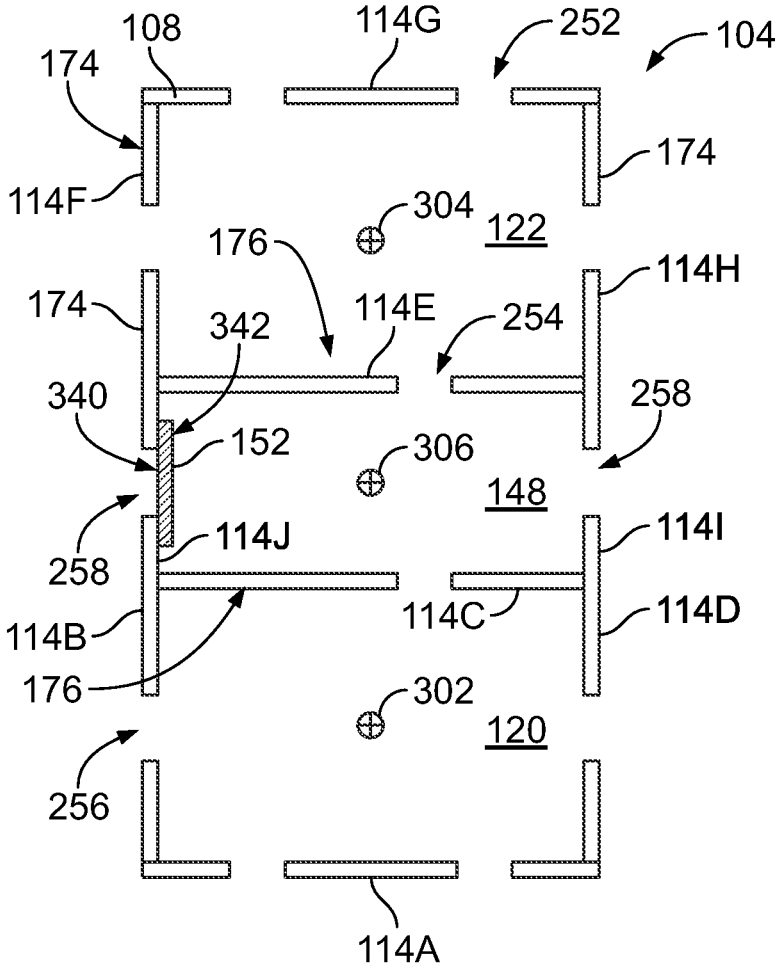
FIG. 6 is a cross-section of the receptacle assembly of FIG. 2 taken transverse to a pair of module cavities and a cable cavity between the module cavities.

FIG. 6 is a cross-section of a portion of the receptacle assembly 104. As shown in FIGS. 4 and 6, the module cavities 120, 122 and the cable cavity 148 are defined by the housing walls 114, which are referenced specifically as housing walls 114A, 114B, 114C, 114D (FIG. 6), 114E, 114F, 114G, 114H (FIG. 6), 114I (FIGS. 6), and 114J. The housing walls 114D and 114H are shown in FIG. 6 and are located opposite housing walls 114B and 114F, respectively. The housing wall 114I is also shown in FIG. 6 and is located opposite the housing wall 114J. Accordingly, the module cavity 120 is defined by the housing walls 114A-114D, which are positioned around and extend parallel to the module axis 302. The module cavity 122 is defined by the housing walls 114E-114H, which are positioned around and extend parallel to the module axis 304. The cable cavity 148 is defined by the housing walls 114C, 114E, 114I, and 114J, which are positioned around and extend parallel to the cavity axis 306. The housing walls 114C, 114E separate the cable cavity 148 from the module cavities 120, 122, respectively.

It is understood that two housing walls, although referenced as separate housing walls, may be part of a common wall or structure. For example, the housing walls 114B, 114J, and 114F are part of a common interior panel 174 and the housing walls 114C, 114E are part of a common port spacer 176. As such, a single interior panel 174 may partially define one module cavity 120, one module cavity 122, and one cable cavity 148 that are stacked with respect to one another. Likewise, a single port spacer 176 may partially define one module cavity 120, one module cavity 122, and one cable cavity 148 that are stacked with respect to one another. Furthermore, it is understood that a single housing wall may define adjacent cavities. For example, the housing wall 114E partially defines the module cavity 122 and the cable cavity 148. As another example, the housing wall 114B partially defines two of the module cavities 120 of the row 116 (FIG. 1).

Each of the housing walls 114C, 114E includes the wall openings 254 that permit airflow therethrough in a direction that is generally parallel to the elevation axis 192 (FIG. 1). The housing walls 114B, 114D, 114F, 114H may include wall openings 256 that permit airflow therethrough in a direction that is generally parallel to the lateral axis 193 (FIG. 1). As shown in FIG. 4, the wall openings 256 that are associated with the module cavity 120 are linearly aligned in a direction parallel to the module axis 302, and the wall openings 256 that are associated with the module cavity 122 are linearly aligned in a direction parallel to the module axis 304. As shown in FIG. 6, the housing walls 114I, 114J also include wall openings 258 that permit airflow therethrough in a direction that is generally parallel to the lateral axis 193.

With respect to FIG. 4, the light source 150 is disposed within the cable cavity 148 and aligned with the cavity axis 306. The flexible cable 152 extends through the cable cavity 148 and couples to the light source 150. As described above, the flexible cable 152 may extend from the light-source connector 156 (FIG. 1) through the wall gap 230 (FIG. 2) and the window 250 (FIG. 3). In some embodiments, the flexible cable 152 may couple directly to the communication connector 142. Also shown in FIG. 4, the front wall 224 includes wall openings 260. The wall openings 260 are positioned to permit light signals 330 (shown in FIG. 5) that are generated by the light source 150 to propagate therethrough.

Figure 5:
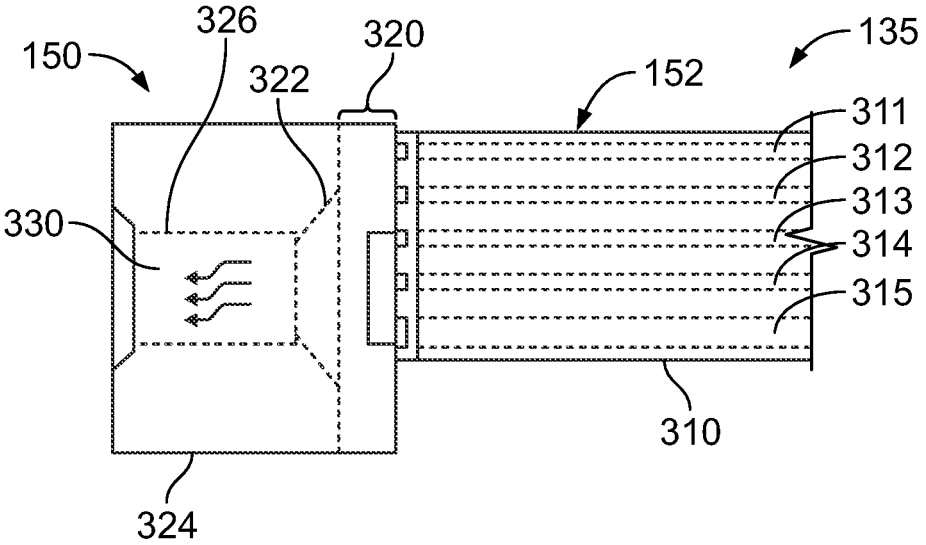
FIG. 5 is a side view of a light-indicator assembly that may be used with the receptacle assembly of FIG. 2 in accordance with an embodiment.

FIG. 5 is a side view of the light-indicator assembly 135 including the light source 150 and the flexible cable 152. In the illustrated embodiment, the flexible cable 152 is a flexible printed circuit (or flex circuit) that includes a flexible insulative body 310. The flexible insulative body 310 may comprise a plurality of polyimide layers. The flexible cable 152 may also include a plurality of conductive traces 311, 312, 313, 314 and, optionally, a power trace 315. The conductive traces 311-314 may transmit data signals and/or electrical power. The power trace 315 is dimensioned larger than the conductive traces 311-314 to transmit electrical power.

The light source 150 includes an indicator base 320 and a plurality of light-emitting elements 322 that are coupled to the indicator base 320. Only one light-emitting element 322 is shown in FIG. 5. The indicator base 320 may be a rigid printed circuit board (PCB) that is electrically coupled to the conductive traces 311-314. Alternatively, the indicator base 320 may be a flexible printed circuit. For example, the indicator base 320 may be a portion of the flexible cable 152. Each of the light-emitting elements 322 may include a semiconductor chip or die having one or more diodes with p-material and n-material configured to emit designated light signals 330 when supplied with a voltage or current. More specifically, the light-emitting elements 322 may be light-emitting diodes (LEDs). The indicator base 320 may include conductive elements (not shown), such as vias and conductive traces, that electrically couple the light-emitting elements 322 to the respective conductive traces 311-314 and, optionally, the power trace 315.

In some embodiments, the light source 150 also includes a device body 324 that includes a plurality of lenses 326. In some cases, the lenses 326 may include or be substituted with short light pipes. The lenses 326 are secured in fixed positions relative to corresponding light-emitting elements 322. The lenses 326 are positioned to receive the light signals 330 from the corresponding light-emitting element 322 and are shaped to direct the emitted light toward the wall opening 260 (FIG. 4) of the front wall 224 (FIG. 2).

The conductive traces 311-314 may transmit the output signals from the light-source connector 156 (FIG. 1) or the communication connector 142 (FIG. 1). More specifically, the conductive traces 311-314 may transmit data signals and/or electrical power to the corresponding light-emitting element 322 and/or circuitry (not shown) within the indicator base 320. The light-emitting elements 322 may be selectively controlled such that each of the light-emitting elements 322 may be activated independently with respect to the other light-emitting elements 322.

In the illustrated embodiment, the light-emitting elements 322 are directly powered by the conductive traces 311-314 such that when current is permitted to flow through the conductive traces 311-314, the light-emitting elements 322 generate the light signals 330 based on the electrical power from the current. By way of example only, each of the light-emitting elements 322 may consume about 1-25 mA at about 1-5 V or, more specifically, about 2-20 mA at about 2-4 V. In other embodiments, the indicator base 320 may include circuitry for processing data signals received through the flexible cable 152 and power the light-emitting elements 322 based on the processed data signals. The light signals 330 will be viewable to a user.

FIG. 5 illustrates one exemplary light-indicator assembly 135, but other light-indicator assemblies may be used. For example, the flexible cable 152 may include one or more insulated wires. As another example, the light source 150 may be other forms of semiconductor light sources, such as another LED or a laser diode.

FIG. 6 shows the receptacle housing 108 and the module cavities 120, 122, with the cable cavity 148 therebetween. The flexible cable 152 is shown extending through the cable cavity 148 along the housing wall 114J. In the illustrated embodiment, the flexible cable 152 covers the wall openings 258 along the housing wall 114J such that airflow is not permitted or significantly impeded. In other embodiments, such as those shown in FIGS. 7-10, the flexible cable 152 may have a different position that permits airflow.

The flexible cable 152 includes opposite broad cable sides 340, 342. The flexible cable 152 is positioned immediately adjacent to the housing wall 114J such that the cable side 340 is directly against the housing wall 114J or has a nominal gap therebetween. In some embodiments, an adhesive (not shown) may be applied between the housing wall 114J and the cable side 340 to facilitate securing the flexible cable 152 to the housing wall 114J. For example, during construction of the receptacle assembly 104, an adhesive may be applied to the interior panels 174. The port spacer 176 having the light-indicator assembly 135 (FIG. 1) within the cable cavity 148 may be coupled to the interior panel 174. Before, after, or while the port spacer 176 is coupled to the interior panels 174, the flexible cable 152 may be pressed against the housing wall 114J. Alternatively or in addition to using an adhesive, a cable locator (not shown) may be used to hold the flexible cable 152 in a designated position. Such cable locators are described with reference to FIGS. 7 and 8. In some embodiments, the flexible cable 152 is immediately adjacent to the housing wall 114J, but is not secured directly to the housing wall 114J. In such embodiments, a relatively small amount of airflow may be permitted through the wall openings 258 between the cable side 340 and the housing wall 114J.

The wall openings 252, 254, 256, and 258 may have predetermined positions with respect to each other and the flexible cable 152 in order to permit a designated airflow through the cable cavity 148 and/or the module cavities 120, 122. The designated airflow may be configured to transfer heat (or thermal energy) away from the receptacle assembly 104. In some embodiments, predetermined portions of the receptacle assembly 104 may generate more heat than other portions. For instance, more heat may be generated at the first and second mating interfaces 144, 146 (FIG. 1) than other portions of the receptacle assembly 104. The designated airflow may be calculated or modeled based on when the pluggable modules 106 (FIG. 1) are engaged to the first and second mating interfaces 144, 146 and transmitting data therethrough.

Figure 7:
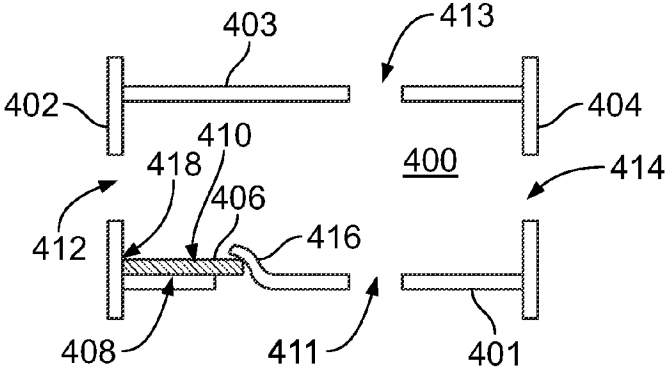
FIG. 7 is a cross-section of a cable cavity that may be used with the receptacle assembly of FIG. 2 in accordance with an embodiment.

FIGS. 7-10 illustrate different configurations of cable cavities and/or flexible cables that may be incorporated with different embodiments of the communication system 100. More specifically, each of the configurations may be used with the receptacle assembly 104 (FIG. 1). For example, FIG. 7 is a cross-section of a cable cavity 400 that may be similar or identical to the cable cavity 148 (FIG. 1). The cable cavity 400 is defined by a plurality of housing walls 401, 402, 403, 404. The housing walls 401-404 have respective wall openings 411, 412, 413, 414. Although each housing wall 401-404 has only a single wall opening in the cross-section shown in FIG. 7, it is understood that the housing walls 401-404 may have a plurality of wall openings along a length of the cable cavity 400 and/or a plurality of wall openings within a single cross-section of the cable cavity 400.

In FIG. 7, the cable cavity 400 has a flexible cable 406 extending therethrough. The flexible cable 406 is a flexible printed circuit (or flex circuit) having opposite broad cable sides 408, 410. The cable side 408 is positioned immediately adjacent to the housing wall 401. The housing wall 401 separates the cable cavity 400 and a module cavity (not shown). The flexible cable 406 is positioned away from the wall openings 411 of the housing wall 401. More specifically, the flexible cable 406 has a designated position that does not obstruct airflow through the wall opening 411 or through the wall opening 412.

In some embodiments, the housing wall 401 includes a cable locator 416 that is configured to engage the flexible cable 406 and hold the flexible cable 406 in a designated position. The designated position may allow a desired airflow. For example, the cable locator 416 is a projection that extends from the housing wall 401 and engages the flexible cable 406. The cable locator 416 holds the flexible cable 406 in a position that is immediately adjacent to the housing wall 401. The flexible cable 406 also engages the housing wall 402 such that the flexible cable 406 extends along a corner 418 defined by the housing walls 401, 402. The cable locator 416 may prevent the flexible cable 406 from inadvertently extending toward a center of the cable cavity 400. In the illustrated embodiment, the cable locator 416 is a portion of the housing wall 401 that is stamped and formed to engage the flexible cable 406. In other embodiments, the cable locator 416 may extend from one of the housing walls 402-404 and engage the flexible cable 406.

Figure 8:
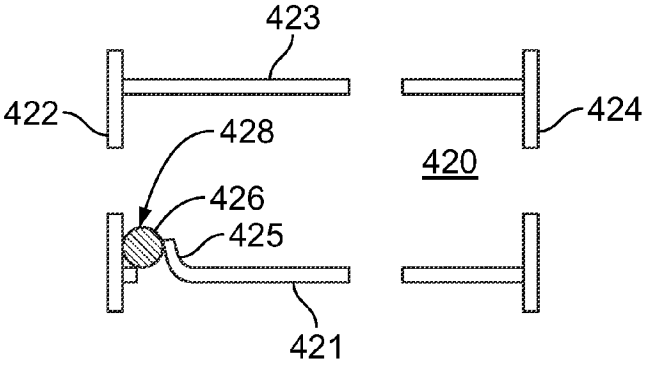
FIG. 8 is a cross-section of a cable cavity that may be used with the receptacle assembly of FIG. 2 in accordance with an embodiment.

FIG. 8 shows a cable cavity 420 and a flexible cable 426 extending through the cable cavity 420. The cable cavity is defined by housing walls 421, 422, 423, 424. In FIG. 8, the flexible cable 426 is an insulated wire that engages each of the housing walls 421, 422. More specifically, the flexible cable 426 may extend along a corner 428 defined by the housing walls 421, 422. Similar to FIG. 7, the housing wall 421 includes a cable locator 425 that engages the flexible cable 426 to facilitate holding the flexible cable 426 in the desired position and/or orientation.

Figure 9:
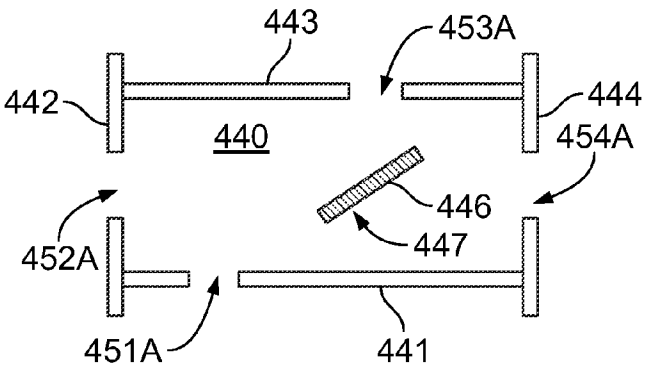
FIG. 9 is a cross-section of a cable cavity that may be used with the receptacle assembly of FIG. 2 in accordance with an embodiment.
Figure 10:
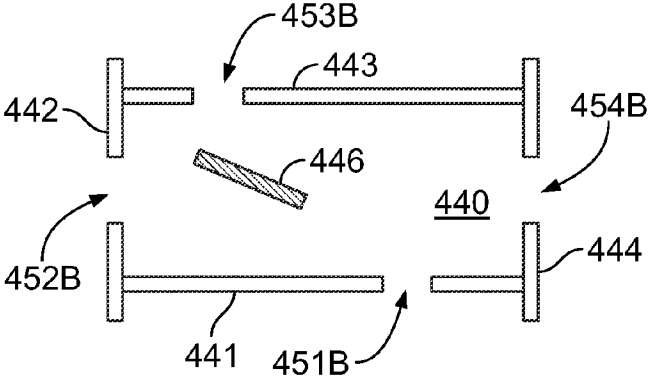
FIG. 10 is a cross-section of a cable cavity that may be used with the receptacle assembly of FIG. 2 in accordance with an embodiment.

FIGS. 9 and 10 illustrate different cross-sections of a common cable cavity 440 that is defined by housing walls 441, 442, 443, 444. A flexible cable 446 extends through the cable cavity 440. In FIG. 9, the housing walls 441-444 have wall openings 451A-454A, respectively. In FIG. 10, the housing walls 441-444 have wall openings 451B-454B. The wall openings 451A, 451B of the housing wall 441 have different lateral locations. Likewise, the wall openings 453A, 453B of the housing wall 443 have different lateral locations. In some embodiments, the flexible cable 446 may be turned or bent to have different lateral positions and/or different elevated positions within the cable cavity 440. The flexible cable 446 may also have a different orientation within the cable cavity 440. For example, the flexible cable 446 in FIG. 10 has been rotated clockwise about 45° with respect to the flexible cable 446 in FIG. 9.

The lateral position, the elevated position, and/or the orientation of the flexible cable 446 in the cable cavity 440 may be configured to obtain a designated airflow and/or heat transfer at different portions within the cable cavity 440. For example, heat generated from the pluggable module (not shown) may be greater at different positions along a length of the cable cavity 440. In FIG. 9, the flexible cable 446 is positioned to engage and direct air flowing through the wall opening 454A to flow into the housing wall 441. More specifically, the flexible cable 446 is a flexible printed circuit having a broad cable side 447 that engages air flowing through the wall opening 454A and directs the air toward the housing wall 441. In FIG. 10, the flexible cable 446 is positioned to engage and direct air flowing through the wall opening 452B to flow into the housing wall 441.

Accordingly, a flexible cable may be located within a cable cavity to reduce or minimize an effect on the air flowing within the cable cavity. Alternatively, a flexible cable may be located within a cable cavity to direct airflow in a desired direction, such as against a pluggable module or a housing wall that interfaces with the pluggable module.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled.

As used in the description, the phrase "in an exemplary embodiment" and the like means that the described embodiment is just one example. The phrase is not intended to limit the inventive subject matter to that embodiment. Other embodiments of the inventive subject matter may not include the recited feature or structure. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112(f), unless and until such claim limitations expressly use the phrase "means for" followed by a statement of function void of further structure.

What is claimed is:

1. A receptacle assembly comprising:

a receptacle housing having a front end, a back end, and an elongated module cavity that extends between the front and back ends, the module cavity having a port opening at the front end that is configured to receive a pluggable module;

a communication connector disposed within the module cavity and positioned to mate with the pluggable module when the pluggable module is inserted into the module cavity;

a light source positioned proximate to the port opening, the light source generating light signals that are viewable at the front end; and a flexible cable coupled to the light source, the light source generating the light signals based on electrical current received through the flexible cable, the light signals indicating a status of a communicative connection between the communication connector and the pluggable module, wherein the flexible cable includes at least one of an insulated wire or a flexible printed circuit.

2. The receptacle assembly of claim 1, wherein the receptacle housing includes a housing wall and a cable cavity, the housing wall separating the module cavity and the cable cavity, wherein the flexible cable extends through the cable cavity.

3. The receptacle assembly of claim 2, wherein the cable cavity extends lengthwise along a cavity axis, the light source being aligned with the cavity axis.

4. The receptacle assembly of claim 2, wherein the housing wall includes a pair of opposing housing walls that define the cable cavity therebetween, at least one of the housing walls including a plurality of wall openings.

5. The receptacle assembly of claim 1, further comprising a light-source connector communicatively coupled to the communication connector and electrically coupled to the flexible cable, the flexible cable extending from the light-source connector to the light source, the light-source connector configured to transmit at least one of data signals or electrical power to the light source based on the status of the communicative connection between the communication connector and the pluggable module.

6. The receptacle assembly of claim 1, wherein the receptacle housing includes a plurality of housing walls having corresponding wall openings, the flexible cable extending along and immediately adjacent to one of the housing walls, the flexible cable being positioned away from the corresponding wall openings to permit air to flow therethrough unobstructed.

7. The receptacle assembly of claim 1, wherein the light source includes a light-emitting diode (LED) and a circuit board coupled to the LED, the LED and the circuit board being proximate to the front end.

8. The receptacle assembly of claim 1, wherein the receptacle housing includes first and second housing walls that define a cable cavity, the flexible cable extending through the cable cavity, the first housing wall having a wall opening, the flexible cable having a broad cable side that is positioned within the cable cavity to deflect air flowing through the wall opening against the second housing wall.

9. The receptacle assembly of claim 1, wherein the receptacle housing includes a plurality of housing walls that define a cable cavity, the flexible cable extending through the cable cavity, wherein the flexible cable occupies less than 15% of a total volume of the cable cavity.

10. The receptacle assembly of claim 9, wherein the cable cavity extends lengthwise along a cavity axis, the light source being aligned with the cavity axis.

11. The receptacle assembly of claim 9, wherein at least one of the housing walls includes a plurality of wall openings.

12. A receptacle assembly comprising:

a receptacle housing having a front end, a back end, and a mating axis extending therebetween, the receptacle housing including first and second module cavities that are stacked with respect to one another and extend generally parallel to the mating axis, each of the first and second module cavities having a respective port opening at the front end that is configured to receive a corresponding pluggable module;

a communication connector having first and second mating interfaces, the first and second mating interfaces positioned within the first and second module cavities, respectively, to mate with the corresponding pluggable modules;

a light source positioned proximate to the front end, the light source generating light signals that are viewable at the front end; and a flexible cable configured to transmit electrical current therethrough and being operably coupled to the light source, the light source generating the light signals based on the electrical current received through the flexible cable, the light signals indicating a status of a communicative connection between the communication connector and at least one of the pluggable modules, wherein the flexible cable includes at least one of an insulated wire or a flexible printed circuit.

13. The receptacle assembly of claim 12, wherein the receptacle housing includes first and second housing walls and a cable cavity defined between the first and second housing walls, the first housing wall separating the first module cavity and the cable cavity, the second housing wall separating the second module cavity and the cable cavity, wherein the flexible cable extends through the cable cavity.

14. The receptacle assembly of claim 13, wherein the cable cavity extends lengthwise along a cavity axis, the light source being aligned with the cavity axis.

15. The receptacle assembly of claim 12, wherein the light source includes a plurality of light-emitting elements.

16. The receptacle assembly of claim 12, wherein the receptacle housing includes a port spacer that separates the first and second module cavities, the port spacer defining a cable cavity that extends between and generally parallel to the first and second module cavities, the flexible cable extending through the cable cavity, the port spacer holding the light source.

17. The receptacle assembly of claim 12, wherein the receptacle housing includes a row of the first module cavities and a row of the second module cavities, the receptacle assembly including a plurality of the light sources positioned between the rows of the first and second module cavities, wherein the flexible cable communicatively couples to at least one of the light sources.

18. The receptacle assembly of claim 12, further comprising a light-source connector communicatively coupled to the communication connector and electrically coupled to the flexible cable, the flexible cable extending from the light-source connector to the light source, the light-source connector configured to transmit at least one of data signals or electrical power to the light source based on the status of the communicative connection.

19. The receptacle assembly of claim 12, wherein the receptacle housing includes first and second housing walls that define a cable cavity, the flexible cable extending through the cable cavity, the first housing wall having a wall opening, the flexible cable having a broad cable side that is positioned within the cable cavity to deflect air flowing through the wall opening against the second housing wall.

20. The receptacle assembly of claim 12, wherein the receptacle housing includes a plurality of housing walls that define a cable cavity, the flexible cable extending through the cable cavity, wherein the flexible cable occupies less than 15% of a total volume of the cable cavity.

* * * * *